US006045384A

United States Patent [19]

Norizuki et al.

[11] Patent Number: 6,045,384

[45] Date of Patent: Apr. 4, 2000

[54] CONNECTOR HAVING TAPERED SURFACES FOR FACILITATING CONNECTION

[75] Inventors: Teruhisa Norizuki; Shinji Kodama, both of Shizuoka, Japan

[73] Assignee: Yazaki Corporation, Tokyo, Japan

[21] Appl. No.: 09/281,061

[22] Filed: Mar. 10, 1999

[30] Foreign Application Priority Data

Mar. 10, 1998 [JP] Japan ..... 10-058523

[51] Int. Cl.[7] ..... H01R 13/62

[52] U.S. Cl. ..... 439/310; 439/157; 439/372

[58] Field of Search ..... 439/345, 357, 439/374, 358, 557, 157, 701, 372

[56] References Cited

U.S. PATENT DOCUMENTS 5,954,528 9/1999 Ono et al. ..... 439/157
5,954,532 9/1999 Matsuura et al. ..... 439/372

FOREIGN PATENT DOCUMENTS 9-55262 2/1997 Japan ..... H01R 13/64
9-82419 3/1997 Japan ..... H01R 13/64

*Primary Examiner*—Lincoln Donovan
*Assistant Examiner*—Hae Moon Hyeon
*Attorney, Agent, or Firm*—Sughrue, Mion, Zinn, Macpeak & Seas, PLLC

[57] ABSTRACT

In a connector (10), the other connector housing (60) can be fitted and disconnected relative to the one connector housing (50) held in the fitting stand-by condition within a cover (30) held in a provisionally-retained condition relative to a holder (20). Provisionally-retaining members (26) and (34) for maintaining the fitting stand-by condition of the one connector housing (50) are provided respectively at the holder (20) and the cover (30), and tapering surfaces (25) and (33) for guiding the fitting movement are respectively formed at those ends of the holder (20) and cover (30) for receiving the other connector housing (60), and the holder (20) and the cover (30) can be provisionally retained relative to each other so that these tapering surfaces (25) and (33) can be disposed substantially flush with each other.

2 Claims, 16 Drawing Sheets

CONNECTOR HAVING TAPERED SURFACES FOR FACILITATING CONNECTION

BACKGROUND OF THE INVENTION

1. Field of the Invention

The present invention relates to a connector in which a pair of male and female connector housings of the multi-pole type can be fitted together and disconnected from each other.

The present application is based on Japanese Patent Application No. Hei. 10-58523, which is incorporated herein by reference.

2. Description of the Related Art

An example of a connector of the above-described type will be briefly described with reference to FIGS. 19 and 20. A male connector housing 2 (which is one connector housing of the connector 1) is made of a synthetic resin, and has a hood cover 3 of a generally square tubular shape fixedly secured thereto by press fitting or the like. This hood cover 3 is slidably mounted in a holder 5 of a generally square tubular shape mounted on a mounting member (not shown) such as a panel of a vehicle body, the holder 5 being made of a synthetic resin. Elastic retaining piece portions 4 each having a rectangular retaining hole 4*a* are formed integrally at opposite sides of the hood cover 3, respectively. Elastic arms 6 are formed integrally at opposite sides of the holder 5, respectively, and each of the elastic arms 6 has at its distal end a projection 6*a* which can be releasably engaged or retained in the associated retaining hole 4*a*.

In a fitting stand-by condition of the male connector housing 2 in which the projections 6*a* of the elastic arms 6 of the holder 5 are provisionally retained respectively in the retaining holes 4*a* of the elastic retaining piece portions 4 of the hood cover 3, a hood portion 7*a* of a female connector housing 7 (which is the other connector housing of the connector), made of a synthetic resin, is fitted into a space between the male connector housing 2 and the hood cover 3, and then the elastic arms 6 of the holder 5 are flexed (elastically deformed) outwardly respectively by projections 8, formed respectively on opposite sides of the female connector housing 7, so that the provisionally-retaining engagement of the male connector housing 2 with the holder 5 is canceled. Therefore, the two connector housings 2 and 7, thus fitted together, can be slid relative to the holder 5 toward the mounting member.

When the two connector housings 2 and 7, fitted together, are to be disconnected from each other, stopper projections 3*a*, formed on the hood cover 3, abut respectively against stopper receiving portions 5*b* formed respectively at front ends of guide grooves 5*a* formed in inner surfaces of the holder 5, thereby limiting the forward movement (forwardly-projected stand-by position) of the male connector housing 2 relative to the holder 5.

In the above-described connector 1, however, the male connector housing 2 and the hood cover 3 are projected from the holder 5 in the fitting stand-by condition of the male connector housing 2, and also hood cover 3 is provisionally retained on the holder 5, with the male connector housing 2 exposed to the exterior through the hood cover 3. Therefore, when the female connector housing 7 is to be fitted on the male connector housing 2, there is a possibility that the female connector housing 7 strikes against the front end of the male connector housing 2 or the front end of the hood cover 3 at the front end of the fitting space, so that the provisionally-retaining engagement of the hood cover 3 with the holder 5 is canceled, and as a result the two connector housings 2 and 7 fail to be fitted together.

SUMMARY OF THE INVENTION

In view of the above-mentioned circumstances, it is an object of the present invention to provide a connector in which when a pair of male and female connector housings are to be fitted together, one of the connector housings can be positively held in a fitting stand-by condition, and also the other connector housing can be smoothly introduced into the one connector housing so that the two connector housings can be fitted together easily and positively.

According to the first aspect of the present invention, there is provided a connector wherein one of a pair of male and female connector housings is retained within a cover in a fitting stand-by condition, and a holder, receiving the cover therein in a provisionally-retained condition, is mounted on a mounting member, and the other connector housing can be fitted and disconnected relative to the one connector housing held in the fitting stand-by condition within the cover held in the provisionally-retained condition relative to the holder, in which provisionally-retaining members for maintaining the fitting stand-by condition of the one connector housing are provided respectively at the holder and the cover; tapering surfaces for guiding the fitting movement of the other connector housing are formed respectively at those ends of the holder and cover for receiving the other connector housing, and the holder and the cover can be provisionally retained relative to each other so that the tapering surface of the holder and the tapering surface of the cover can be disposed substantially flush with each other.

In this connector, when fitting the male and female connector housings together, the other connector housing can be smoothly introduced into the one connector housing because of the provision of the tapering surfaces of the holder and cover. Therefore, the other connector housing will not strike against the fitting-side ends of the holder and cover, and therefore the provisionally-retaining engagement between the holder and the cover will not be canceled, and the two connector housings can be fitted together easily and positively. Therefore, the fitting ability of the two connector housings, as their-reliability, are enhanced.

In the connector, preferably, if a tapering angle of the tapering surface of the holder is represented by X, and a tapering angle of the tapering surface of the cover is represented by Y, the tapering surfaces are so formed that $Y \geqq X$ can be established.

In this connector, even if the other connector housing strikes against the fitting-side ends of the holder and cover, the other connector housing can be easily and positively guided toward the one connector housing through the tapering surfaces of the holder and cover, and therefore the improper fitting connection between the male and female connector housings is prevented.

DETAILED DESCRIPTION OF THE PREFERRED EMBODIMENT

Figure 1:
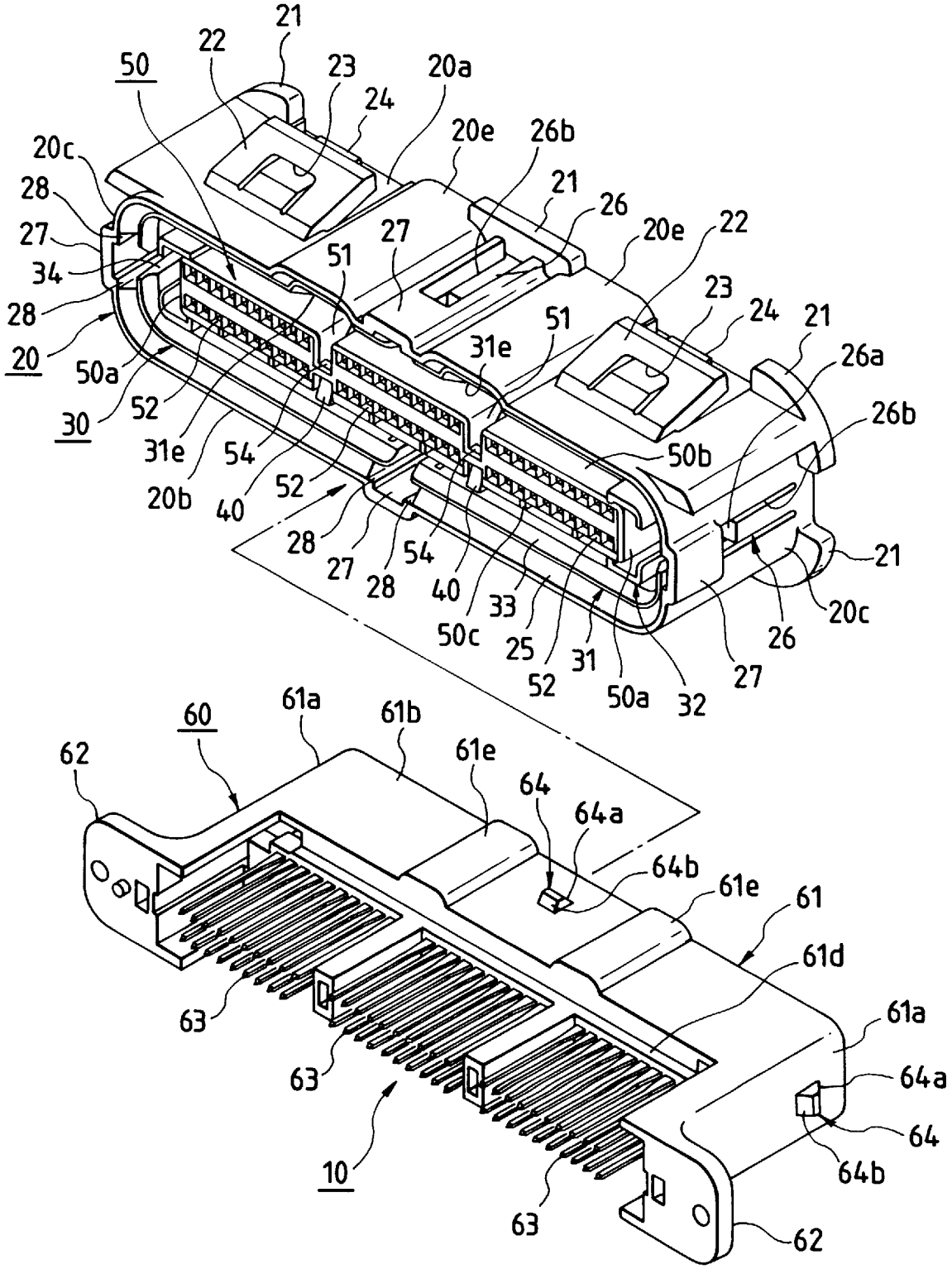
FIG. 1 is a perspective view of a pair of male and female connector housings of one preferred embodiment of a connector of the present invention, showing a condition before the two connector housings are fitted together.
Figure 2:
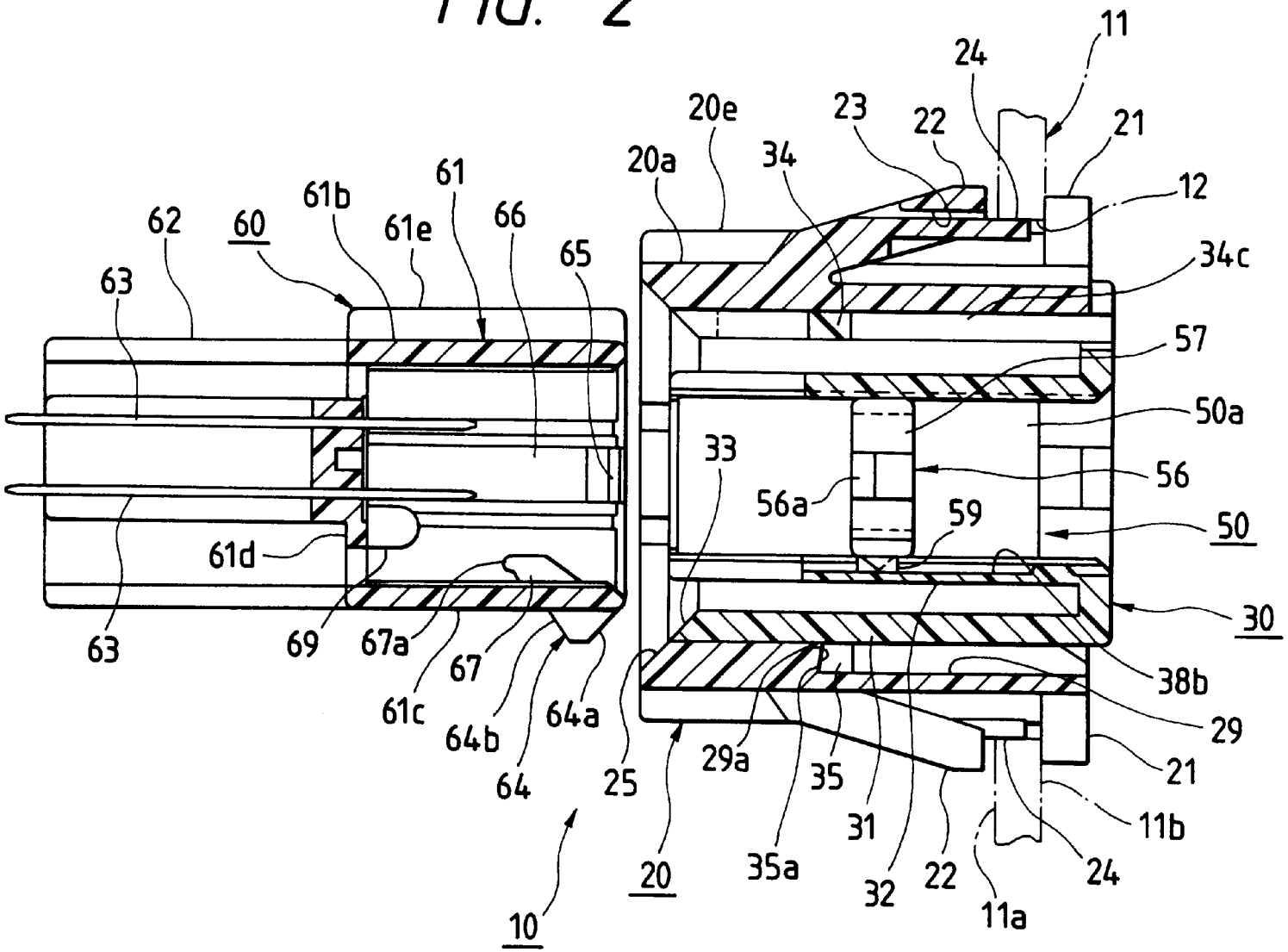
FIG. 2 is a cross-sectional view showing a condition before the two connector housings are fitted together.
Figure 3:
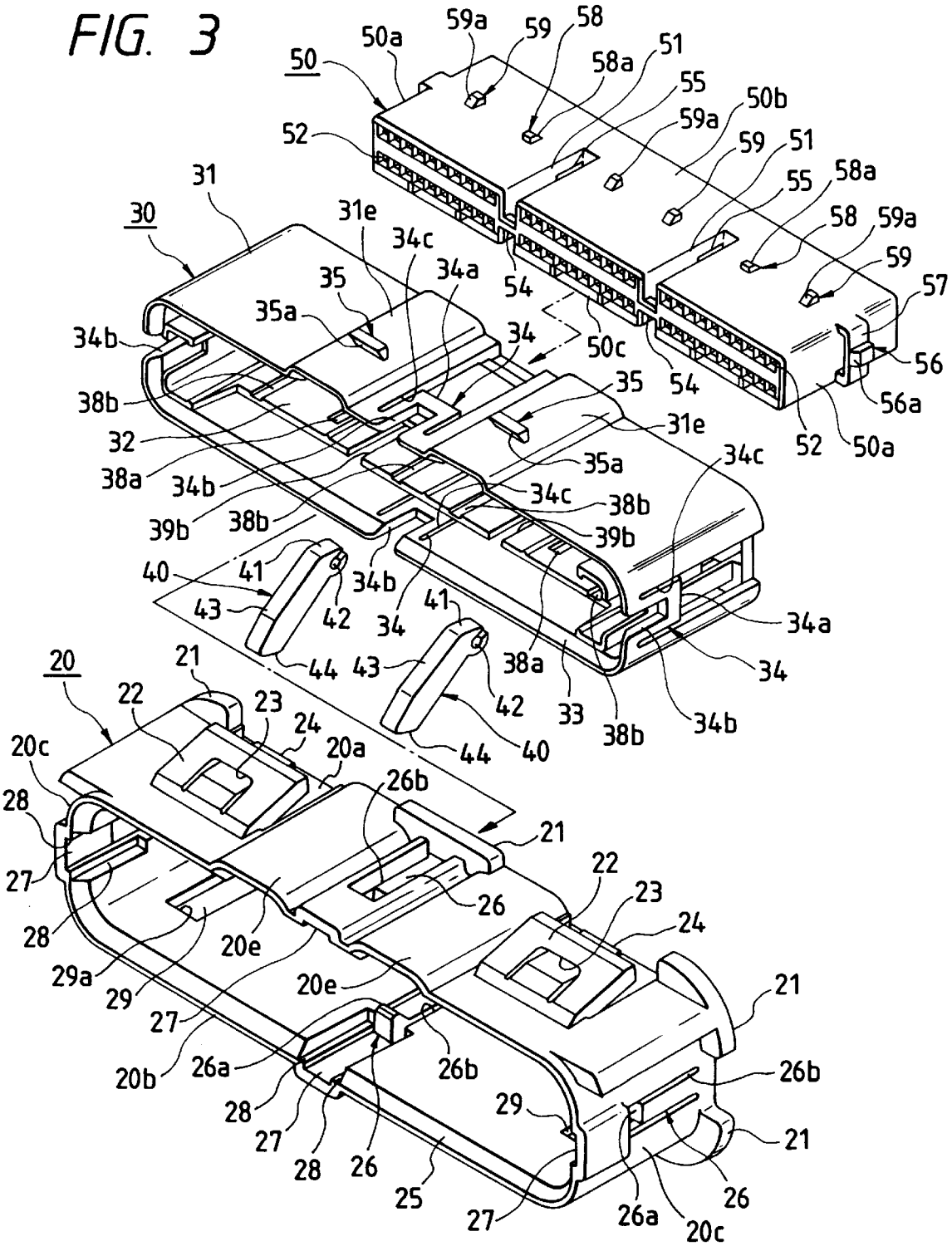
FIG. 3 is an exploded, perspective view of the male connector housing.
Figure 4:
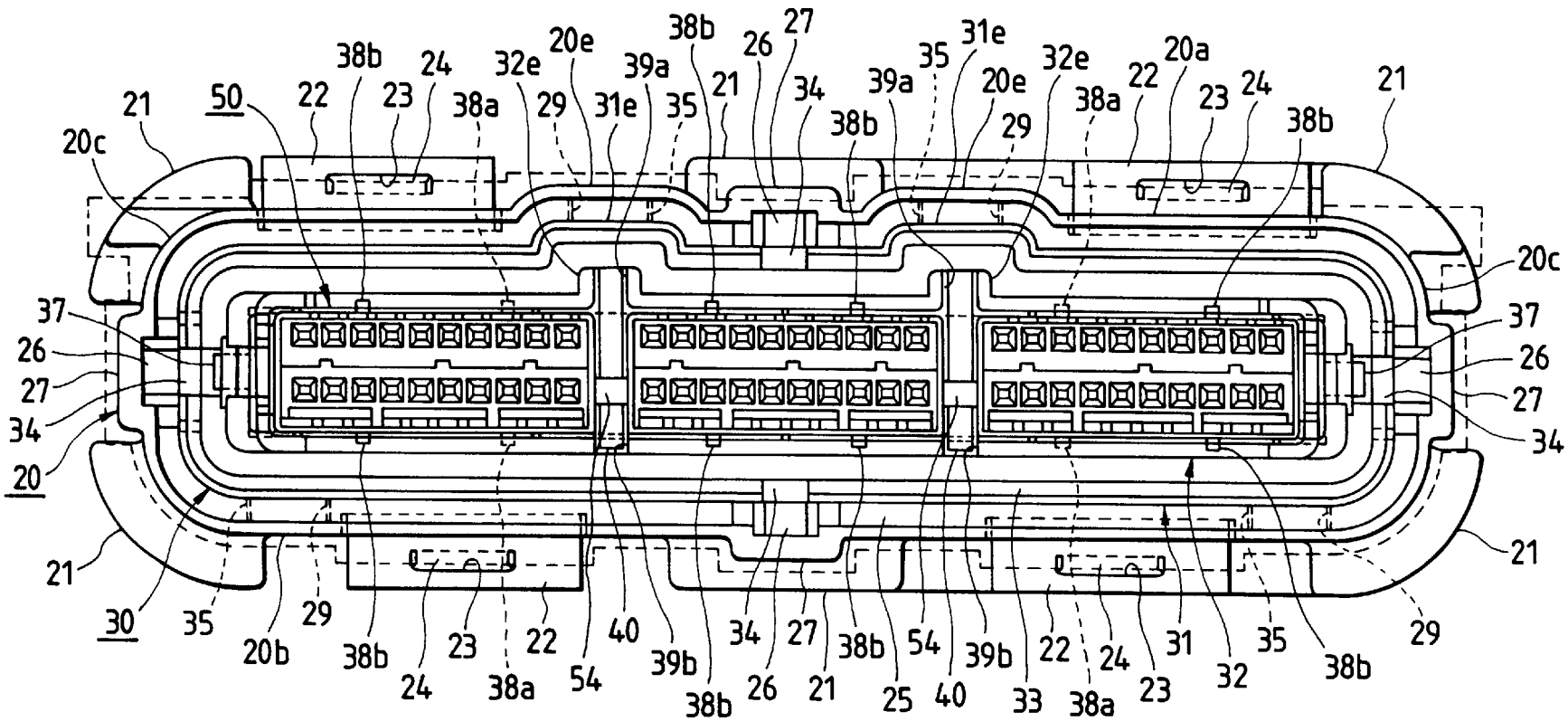
FIG. 4 is a front-elevational view of the male connector housing.

One preferred embodiment of the present invention will now be described with reference to the drawings. FIG. 1 is a perspective view of a pair of male and female connector housings of one preferred embodiment of a connector of the present invention, showing a condition before the two connector housings are fitted together, FIG. 2 is a cross-sectional view showing a condition before the two connector housings are fitted together, FIG. 3 is an exploded, perspective view of the male connector housing, and FIG. 4 is a front-elevational view of the male connector housing. In the description given below, the fitting side of each of the male and female connector housings will be referred to as "front side".

As shown in FIGS. 1 to 3, the connector 10 comprises a holder 20 of a generally rectangular tubular shape which is made of a synthetic resin, and is adapted to be mounted in a mounting hole 12 in an inner panel (mounting member) 11 of a vehicle, a cover 30 of a generally rectangular tubular shape which is made of a synthetic resin, and is provisionally retained within the holder 20 in a substantially completely-received condition, and can slide in a forward-backward direction, a pair of levers 40 and 40 which are made of a synthetic resin, and are pivotally mounted at their proximal ends on the cover 30 so as to bring the pair of male and female connector housings 50 and 60 into and out of fitting engagement with each other, the male connector housing (one connector housing) 50 which is made of a synthetic resin, and is provisionally retained within the cover 30 in a fitting stand-by condition, and can reciprocally slide, and the female connector housing (the other connector housing) 60 which is made of a synthetic resin, and can be fitted on and disconnected from the male connector housing 50 disposed in the fitting stand-by condition.

As shown in FIGS. 1 to 3, the holder 20 has a flattened, generally rectangular tubular shape defined by upper and lower walls 20*a* and 20*b* and opposite side walls 20*c* and 20*c*, and the cover 30 is slidably supported within the holder 20. Stoppers 21 are integrally formed respectively on four corner portions of the holder 20 at the rear open end thereof, and extend outwardly perpendicularly to the walls 20*a*, 20*b* and 20*c*, and also a stopper 21 is integrally formed on the rear edge (or end) of each of the upper and lower walls 20*a* and 20*b* at a central portion thereof, and extends outwardly perpendicularly thereto. Elastic retaining portions 22 are integrally formed respectively on opposite side portions of each of the upper and lower walls 20*a* and 20*b*, and are slanting upwardly toward the rear side. Each elastic retaining portion 22 has an integral aligning portion 24 extending horizontally rearwardly via a U-shaped slit 23.

Figure 10:
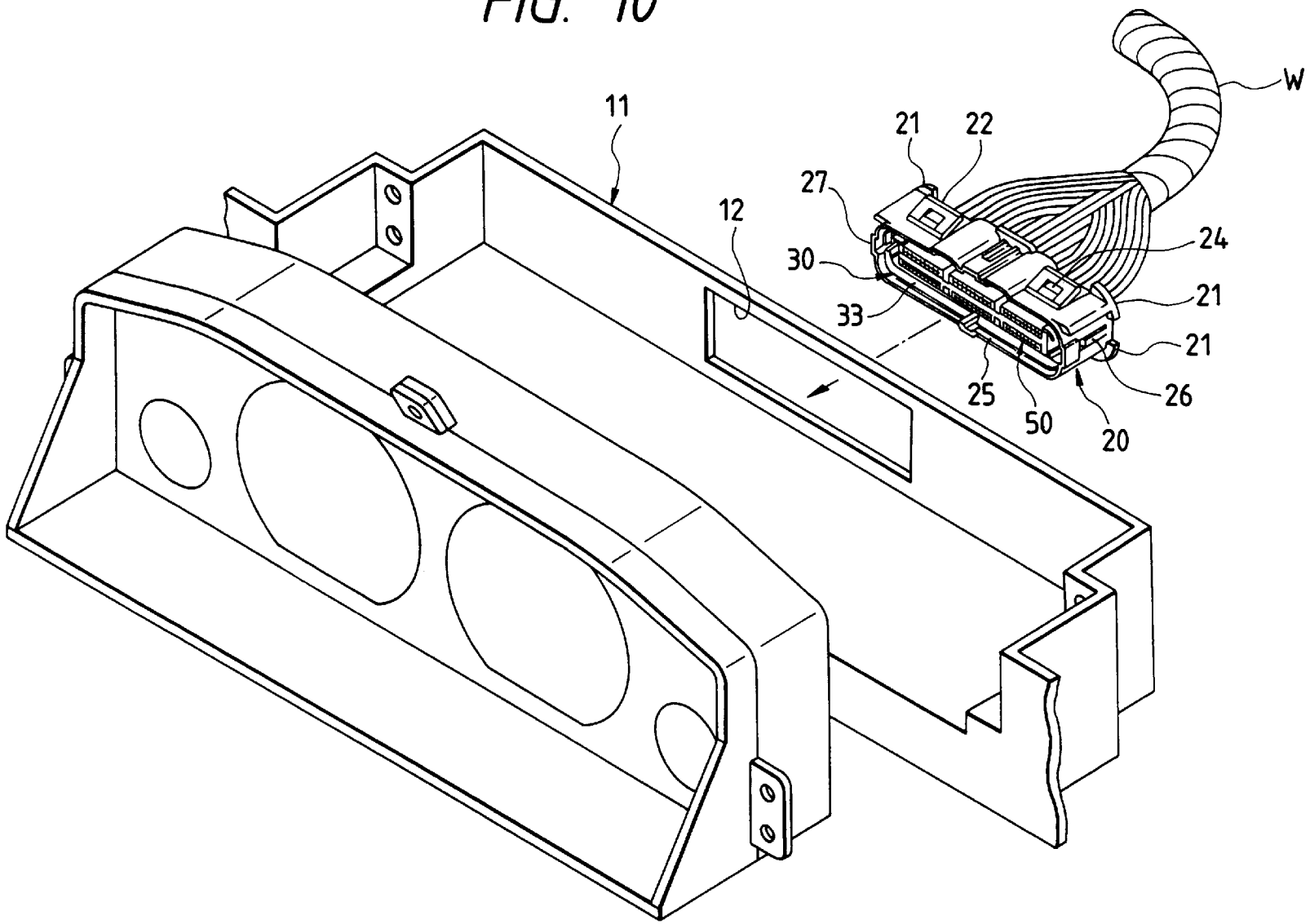
FIG. 10 is a perspective view of the connector to be mounted on an inner panel.
Figure 11:
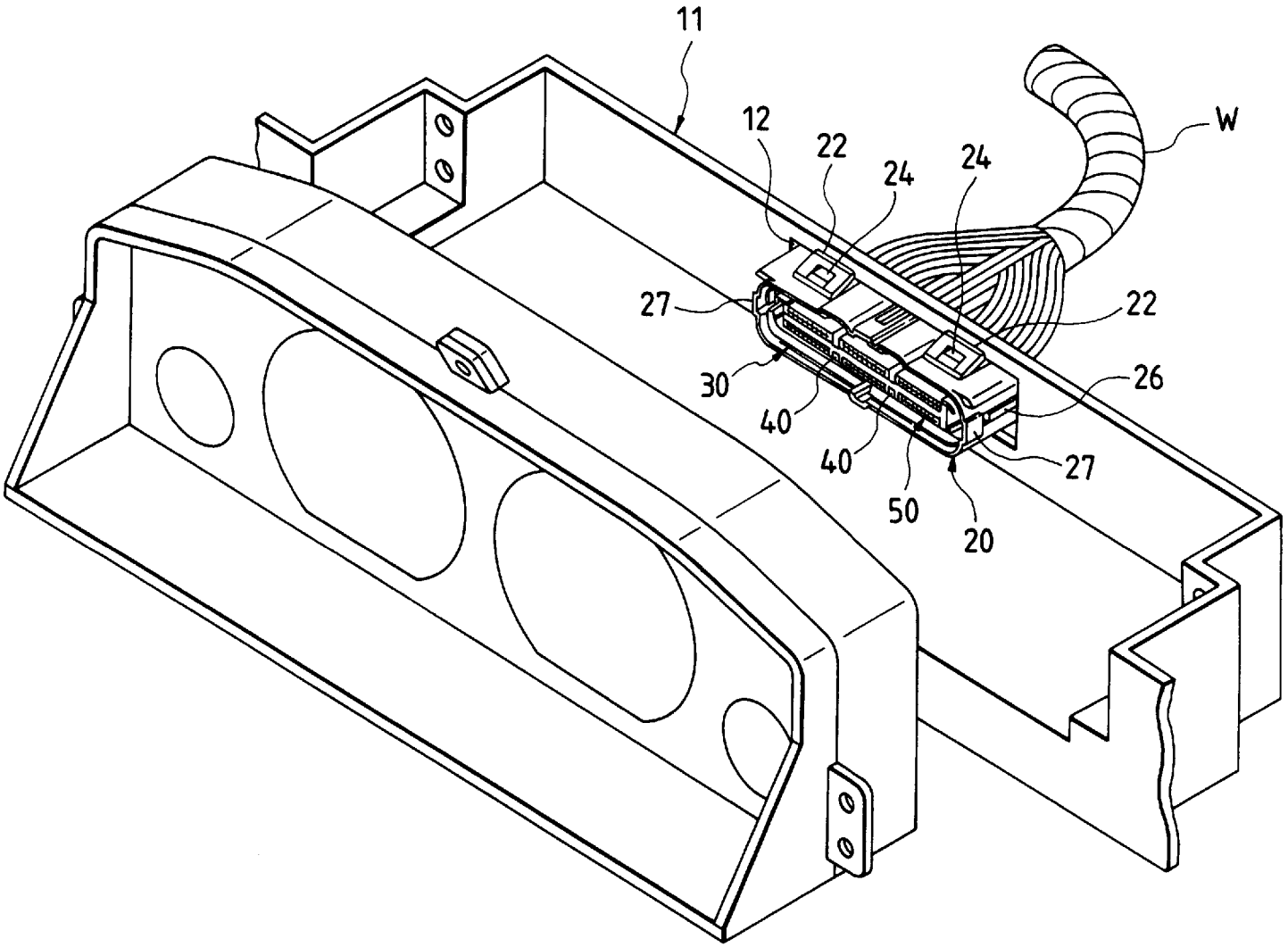
FIG. 11 is a perspective view of the connector mounted on the inner panel.

As shown in FIG. 2, the distance between the outer surfaces of the corresponding aligning portions 24 and 24, formed respectively on the upper and lower walls 20*a* and 20*b*, is equal to a dimension of the mounting hole 12 in the inner panel 11 in as direction of a height thereof. The male connector housing 50 is provisionally retained within the cover 30, and the cover 30 is provisionally retained within the holder 20, and in this assembled condition shown in FIG. 1, when the holder 20 is inserted or passed through the mounting hole 12 in the inner panel 11 from the rear side as shown in FIGS. 10 and 11, the elastic retaining portions 22 are flexed (elastically deformed) inwardly, so that that portion of the inner panel 11, defining a peripheral edge portion of the mounting hole 12, is held between the elastic retaining portions 22 (held against a front surface 11*a* of the inner panel 11) and the stoppers 21 (held against a rear surface 11*b*), thereby retaining this assembly relative to the inner panel 11. At this time, the aligning portion 24, formed integrally on each of the upper and lower elastic retaining portions 22 via the slit 23, is fitted in the mounting hole 12 in an elastically-deformable condition.

Figure 5:
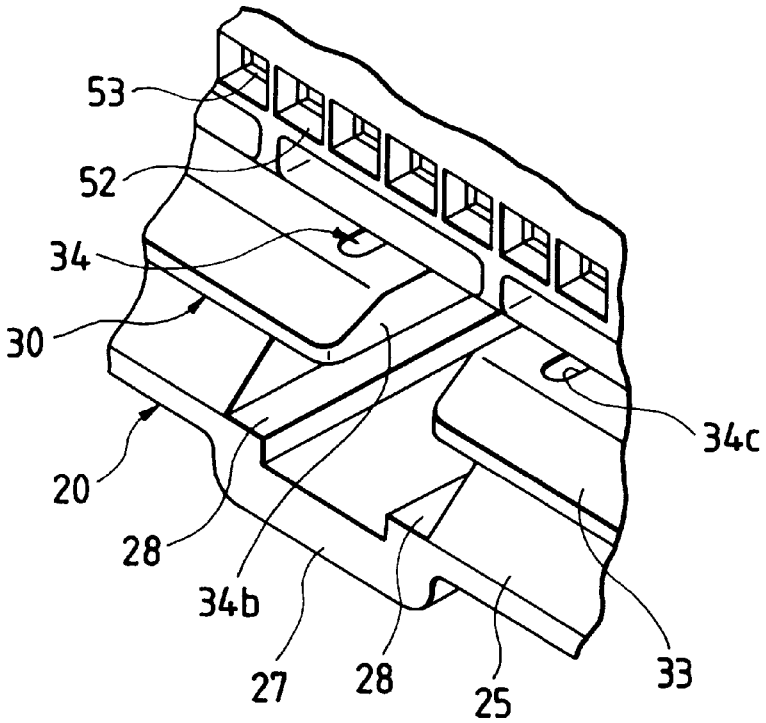
FIG. 5 is a perspective view of an important portion of the male connector housing.

As shown in FIGS. 1 to 3, a tapering surface 25 for guiding the fitting movement of the female connector housing 60 is formed at the front open end (i.e., the end for receiving the female connector housing 60) of the holder 20, formed by the four walls 20*a*, 20*b* and 20*c*, over the entire periphery thereof. An elastic arm 26 of an L-shape is formed integrally on a central portion of each of the four walls 20*a*, 20*b* and 20*c* of the holder 20 via a U-shaped slit 26*b*, and extends rearwardly. As shown in FIG. 7C, a projection (retaining portion) 26*a* of a trapezoidal cross-section is integrally formed at a distal end of each elastic arm 26 at an inner surface thereof. A recessed portion 27 for preventing the expansion of the holder is formed integrally at that portion of each of the four walls 20*a*, 20*b* and 20*c* of the holder 20 disposed forwardly of the elastic arm 26 in adjacent relation thereto, the recessed portion 27 projecting outwardly into a U-shape. As shown in FIGS. 1 and 5, a pair of escape portions (reception spaces) 28 and 28 for receiving an elastic retaining piece portion 34 (described later) of the cover 30 are formed respectively in opposite inner side surfaces of each of the recessed portions 27 formed respectively on the four walls 20*a*, 20*b* and 20*c* of the holder 20, and extends from the front side to the intermediate portion.

Figure 18:
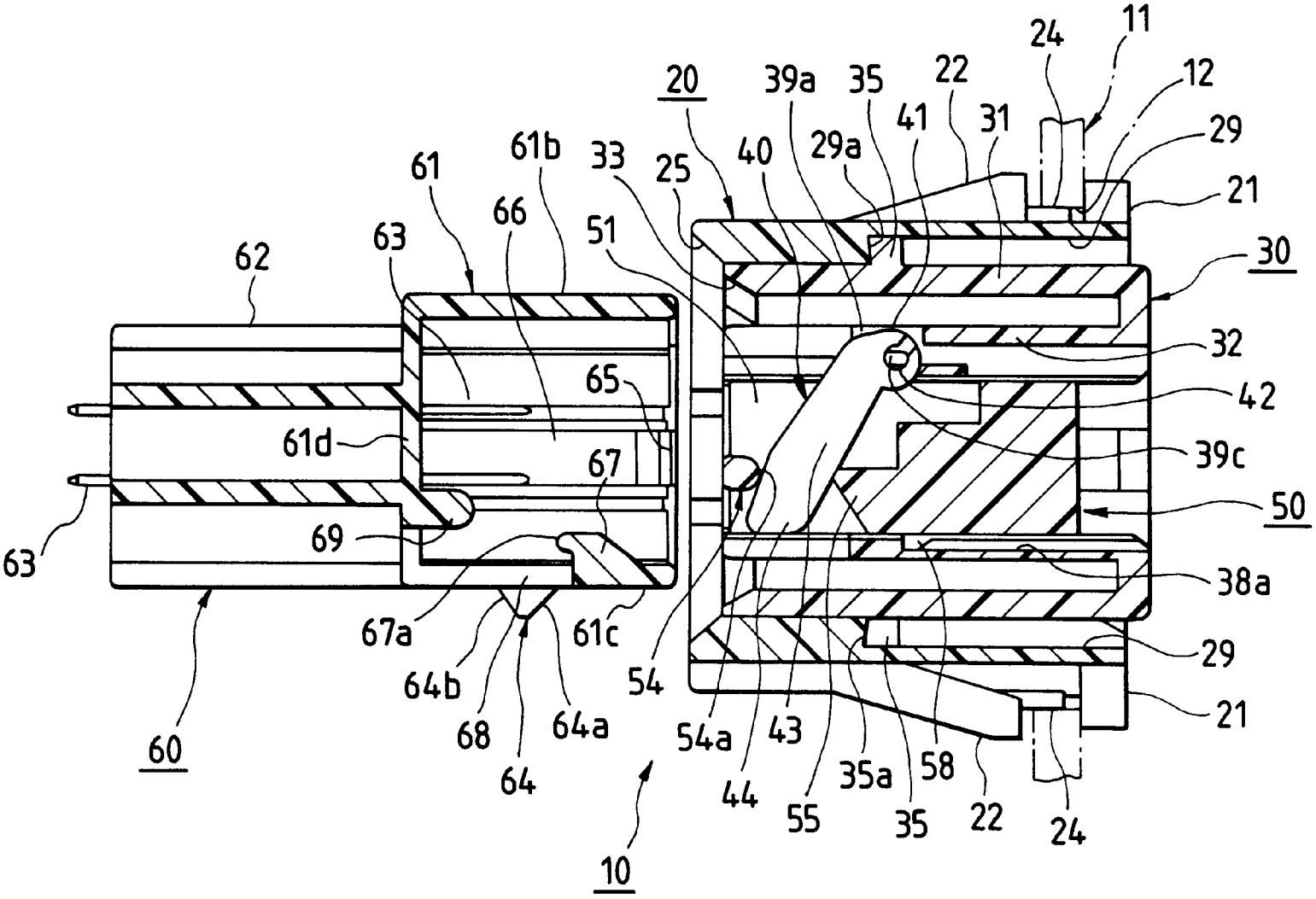
FIG. 18 is a cross-sectional view showing the connector in its disconnected condition.
Figure 19:
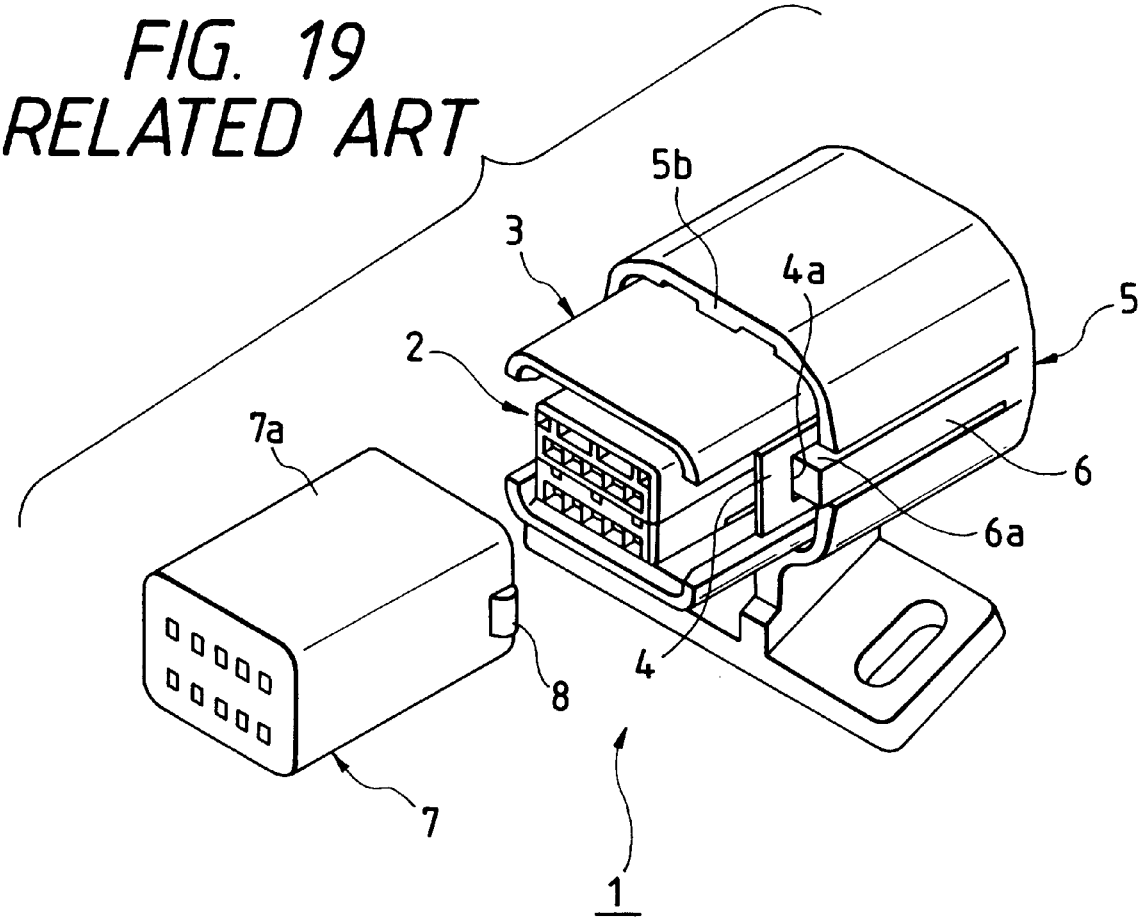
FIG. 19 RELATED ART
FIG. 19 is a perspective view of the related connector, showing a condition before two connector housings are fitted together.
Figure 20:
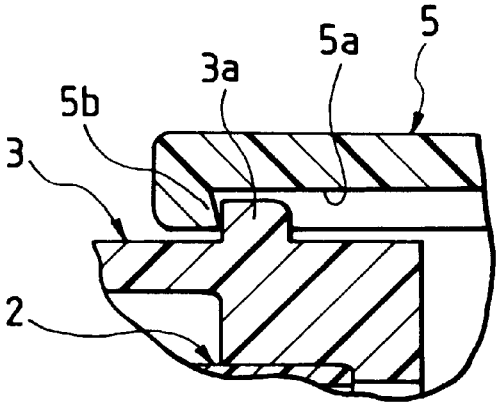
FIG. 20 RELATED ART
FIG. 20 is a fragmentary view showing an important portion of the related connector.

As shown in FIGS. 3 and 4, a pair of guide grooves 29 and 29 are formed in the inner surface of the upper wall 20*a* of the holder 20, that is, are formed respectively in reinforcing portions of high rigidity disposed near respectively to the levers disposed on the opposite sides of the central recessed portion 27. Also, a pair of guide grooves 29 and 29 are formed in the inner surface of the lower wall 20*b*, that is, are formed respectively in those portions of high rigidity disposed near respectively to reinforcing portions for the stoppers 21. As shown in FIGS. 2 and 18, a slanting surface 29*a* is formed at a front end of each of the guide grooves 29.

As shown in FIGS. 3 and 7, the cover 30 has a double wall construction, and more specifically includes an outer wall 31 of a flattened, generally rectangular tubular shape, and an inner wall 32 of a flattened, generally rectangular tubular shape formed integrally within the outer wall 31. A hood portion 61 (described later) of the female connector housing 60 is inserted into a space between the outer and inner walls 31 and 32 each having an open front side or end. The male connector housing 50 can be provisionally retained within the inner wall 32 in a fitting stand-by condition, and can slide therein.

Figure 6:
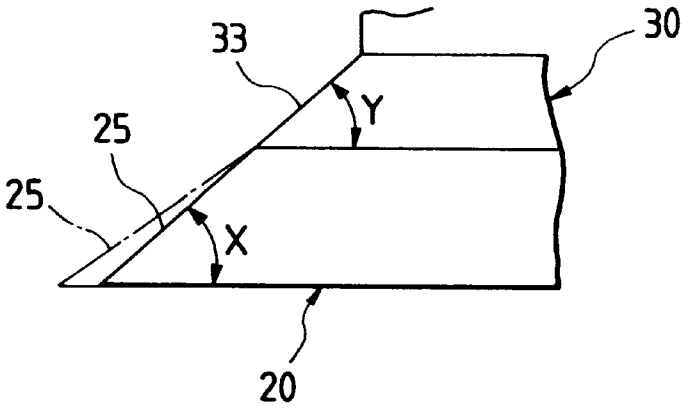
FIG. 6 is a view explanatory of an important portion of the male connector housing.

As shown in FIGS. 1 to 3, 5 and 6, a tapering surface 33 for guiding the fitting movement of the female connector housing 60 is formed at the front open end (i.e., the end for receiving the female connector housing 60) of the outer wall 31 of the cover 30 over the entire periphery thereof. When the elastic arms 26 of the holder 20 are provisionally retainingly engaged respectively with elastic retaining piece portions 34 (described later) of the cover 30, the tapering surface 33 of the cover 30 and the tapering surface 25 of the holder 20 are disposed substantially flush with each other (the front end of the tapering surface 33 of the cover 30 is disposed substantially at the same position as that of the rear end of the tapering surface 25 of the holder 20, or is disposed or slightly rearwardly of this rear end). More specifically, as shown in FIG. 6, if the tapering angle of the tapering surface 25 of the holder 20 is represented by X, and the tapering angle of the tapering surface 33 of the cover 30 is represented by Y, the tapering surfaces 25 and 33 are so formed that $Y \geqq X$ can be established.

As shown in FIGS. 3, 7A, 7B and 7C, the elastic retaining piece portions 34 for holding the male connector housing 50 in the fitting stand-by condition are integrally formed respectively at central portions of front portions of upper and lower wall portions and opposite side wall portions of the outer wall 31 of the cover 30. Each of these provisionally-retaining members 34 comprises elastic retaining piece portions 34 is of a U-shape which can be retainingly engaged with and disengaged from the projection 26*a* of the associated elastic arm 26 of the holder 20. More specifically, the elastic retaining piece portion 34, serving as the provisionally-retaining member, has a central recess 34*b* and a generally C-shaped notch 34*c* so as to be elastically deformed outwardly. The projection 26*a* of the elastic arm 26 of the holder 20 can be retainingly abutted against and disengaged from a distal end surface 34*a* of the elastic retaining piece portion 34. The retaining piece portion 34 and elastic arms together constitute provisional retaining members.

As shown in FIGS. 2, 3 and 4, stopper projections 35 are integrally formed respectively on those portions of the outer surface of the outer wall 31 of the cover 30 which are to be opposed respectively to the guide grooves 29 in the holder 20. A slanting surface 35*a*, slanting in the same direction as that of the slanting surface 29*a* formed at the front end of the guide groove 29 in the holder 20, is formed at a front end or side of the stopper projection 35, and when the male connector housing 50 is in the fitting stand-by condition, the slanting surface 35*a* of each stopper projection 35 of the cover 30 is held against the slanting surface 29*a* formed at the front end of the associated guide groove 29 in the holder 20.

Figure 7A:
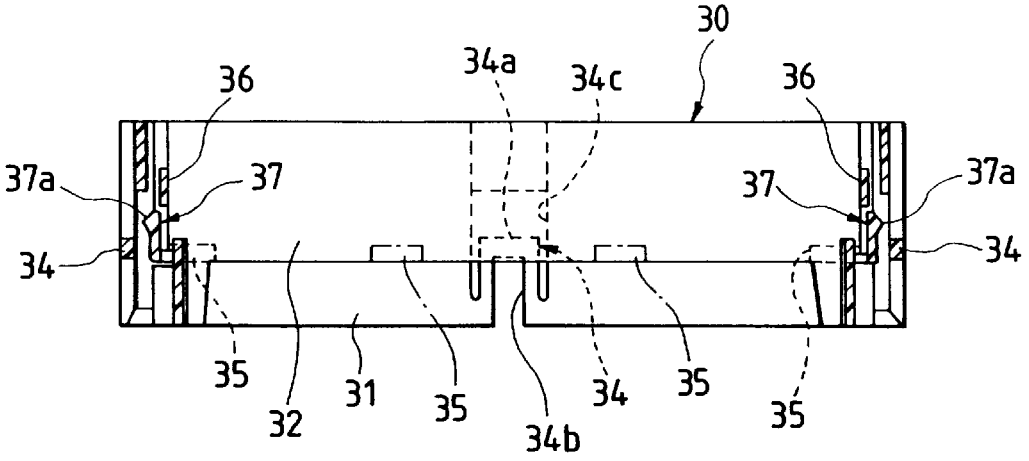
FIG. 7A is a cross-sectional view a cover for holding the male connector housing.
Figure 7B:
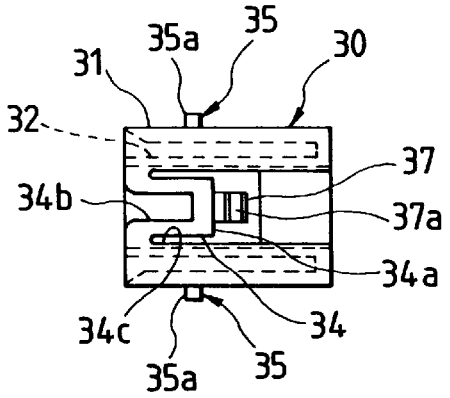
FIG. 7B is a side-elevational view of the cover.
Figure 7C:
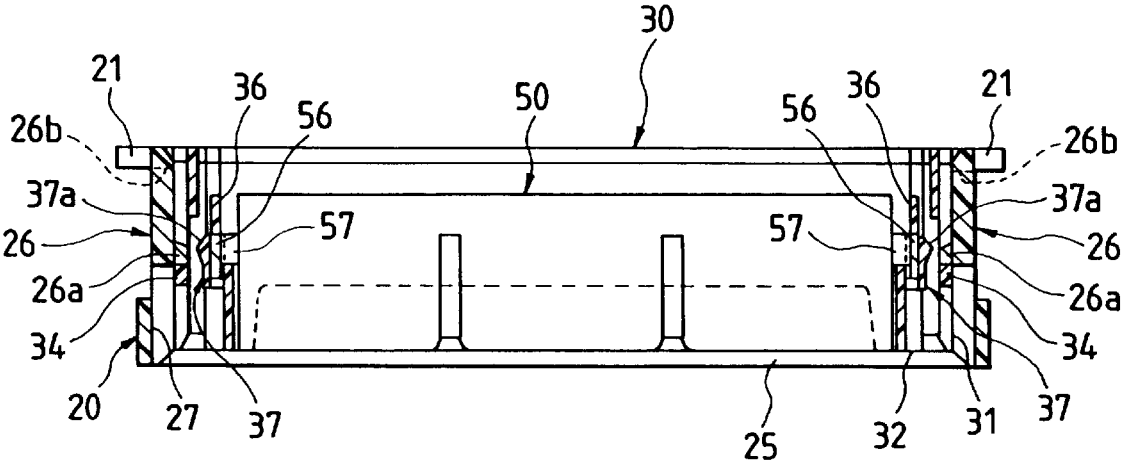
FIG. 7C is a cross-sectional view of a holder for receiving the cover.
Figure 8A:
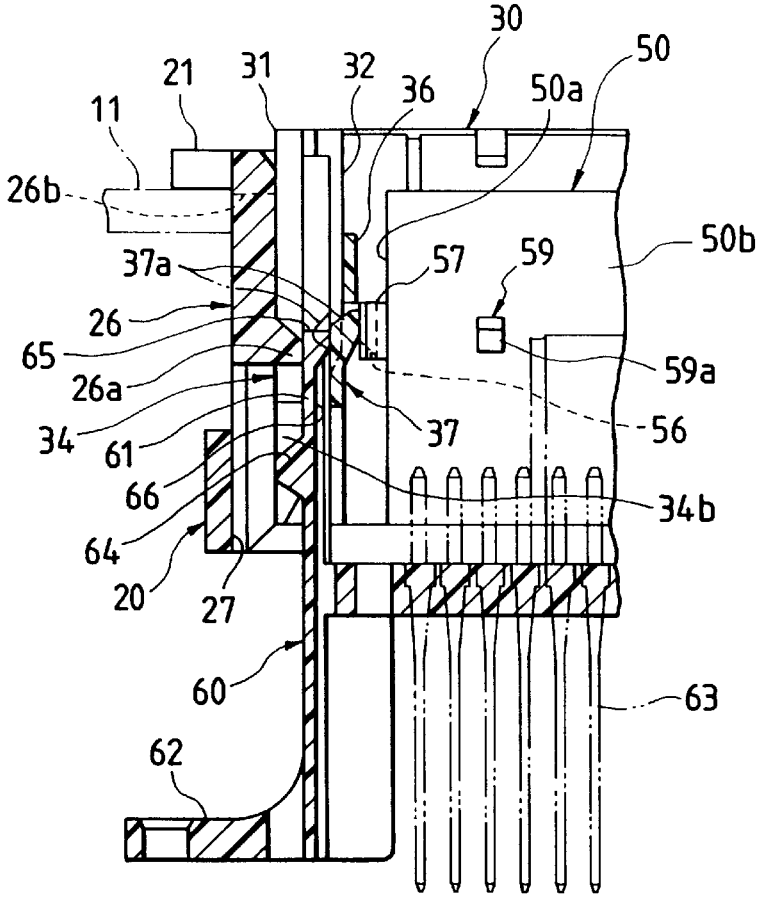
FIG. 8A is a cross-sectional view of important portions of the male and female connector housings, showing an initial stage of the fitting connection between the two connector housings.

As shown in FIGS. 7A, 7B and 7C, provisionally-retaining stopper portions 36 are integrally formed respectively at central portions of opposite side wall portions of the inner wall 32 of the cover 30. Provisionally-retaining lock portions 56 (described later) of the male connector housing 50 can be provisionally retainingly engaged respectively with the provisionally-retaining stopper portions 36 in the fitting stand-by condition of the male connector housing 50. Provisional-retainment cancellation arms 37 of an elastic nature, each having a projection 37*a* formed on an outer surface thereof at a distal end portion thereof, are integrally formed respectively on central portions of front portions of the opposite side wall portions of the inner wall 32 of the cover 30, and are disposed outwardly of the provisionally-retaining stopper portions 36, respectively. As shown in FIG. 8A, each elastic provisional-retainment cancellation arm 37 is elastically deformed inwardly by an associated provisional-retainment cancellation projection 65 (described later) of the female connector housing 60, and as a result of this elastic deformation of the provisional-retainment cancellation arm 37, the provisionally-retaining lock portion 56 of the male connector housing 50 is pressed inwardly, so that the provisional retaining engagement of each provisionally-retaining stopper portion 36 with the associated provisionally-retaining lock portion 56 of the male connector housing 50 is canceled.

As shown in FIGS. 3, 7A, 7B and 7C, the upper and lower wall portions of the inner wall 32 of the cover 30 are notched at their front central portions, and the inner wall 32 has such a size as to substantially fully receive the male connector housing 50 in its fitting stand-by condition. A plurality of guide grooves 38*a* and 38*b* are formed in the inner surfaces of the upper and lower wall portions of the inner wall 32, and these guide grooves 38*a* and 38*b* are provided in those portions of the inner wall 32 disposed near to the U-shaped portions (which are less liable to be deformed) of the cover 30 and also in those portions of high rigidity disposed near to the levers. As shown in FIG. 4, a pair of lever escape grooves 39*a* and 39*a* are formed in the upper wall portion of the inner wall 32 of the cover 30, and are disposed respectively on opposite sides of a central portion of this upper wall portion, and similarly a pair of lever escape grooves 39*b* and 39*b* are formed in the lower wall portion of the inner wall 32, and are disposed respectively on opposite sides of a central portion of this lower wall portion. One lever 40 is provided between the lever escape grooves 39*a* and 39*b* opposed to each other whereas the other lever 40 is provided between the lever escape grooves 39*a* and 39*b* opposed to each other.

As shown in FIGS. 3 and 4, each of the levers 40 is made of a synthetic resin, and has a generally rectangular plate-like shape, and a pivot hole 42 is formed through a central portion of its proximal end 41 having an arcuate contour. As shown in FIG. 18, a support shaft 39*c*, projected into the lever escape groove 39*a* in the upper wall portion of the inner wall 32 of the cover 30, is fitted in the pivot hole 42, so that the lever 40 is pivotally supported at its proximal end 41.

As shown in FIG. 3, the male connector housing 50 is made of a synthetic resin, and has a generally rectangular parallelepiped shape, and this male connector housing 50 has a pair of lever escape grooves 51 and 51 extending from its front side to its rear portion. A plurality of terminal receiving chambers 52 are formed in the male connector housing 50, and extend between its front and rear sides. Female terminals 53 are received in these terminal receiving chambers 52, respectively, and when the two connector housings 50 and 60 are fitted together, these female terminals 53 are electrically connected respectively to male terminals 63 (described later) in the female connector housing 60, thereby electrically connecting the two connector housings 50 and 60 together. A wire harness W, shown in FIGS. 10 and 11, is connected to the female terminals 53.

A bar-like guide portion (operating point portion) 54, serving as a lever engagement portion, is integrally formed at a front end portion of each lever escape groove 51 in the male connector housing 50. As shown in FIG. 18, the guide portion 54 has an arcuate surface 54*a* for sliding contact with an intermediate portion 43 of the lever 40, and therefore this arcuate surface 54*a* serves as an operating point for the lever 40. A lever push portion 55 of a generally trapezoidal shape is integrally formed on one side surface of each lever escape groove 51 at a rear portion thereof, and when the male connector housing 50 is in the fitting stand-by condition, the intermediate portion 43 of the lever 40 is held in sliding contact with this lever push portion 55. The distance between the guide portion 54 and the lever push portion 55 is small as shown in FIG. 18.

The provisionally-retaining lock portions 56 of a trapezoidal shape are formed respectively on opposite side surfaces 50*a* and 50*a* of the male connector housing 50, and these lock portions 56 can be provisionally retainingly engaged respectively with the provisionally-retaining stopper portions 36 of the cover 30 in the fitting stand-by condition of the male connector housing 50. Elastic arms 57 of a U-shape are formed integrally on the opposite side surfaces 50*a* and 50*a*, and the provisionally-retaining lock portion 56 is formed integrally on each of these elastic arms 57, and has a slanting surface 56*a* formed at its front end. Stopper projections 58 and 59 are these upper and lower surfaces 50*b* and 50*c* of male connector housing 50 which are to be opposed respectively to the guide grooves 38*a* and 38*b* in the inner wall 32 of the cover 30, and the stopper projections 58 and 59 can slide along the guide 34 projections 58 limit the forward sliding movement of the male connector housing 50, and the other stopper projections 59 limit the rearward sliding movement of the male connector housing 50. A slanting surface 58*a* is formed on each stopper projection 58, and a slanting surface 59*a* is formed on each stopper projection 59, and the slanting surfaces 58*a* and 59*a* face generally away from each other.

Figure 9:
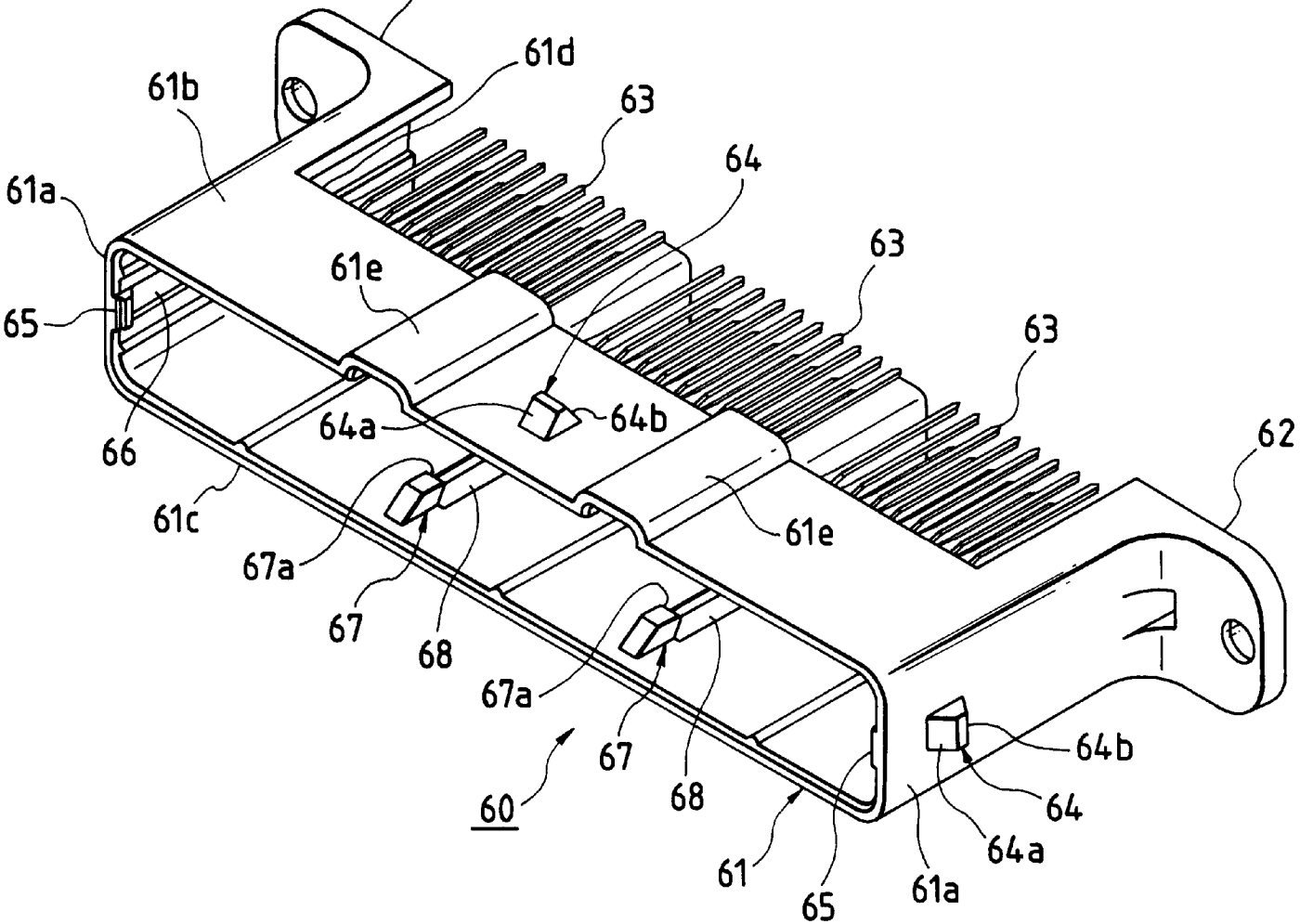
FIG. 9 is a perspective view of the female connector housing as seen from its front side.

As shown in FIGS. 1 and 9, the female connector housing 60 has the plurality of male terminals 63 which are arranged between two leg portions 62 and 62 of an L-shape in an exposed manner, and extend into the hood portion 61 of a rectangular tubular shape. When the two connector housings 50 and 60 are fitted together, the hood portion 61 is inserted in the space between the outer and inner walls 31 and 32 of the cover 30, so that the terminals 63 in the female connector housing 60 are electrically connected respectively to the terminals 53 in the male connector housing 50.

As shown in FIGS. 1 and 9, projections 64 are integrally formed respectively on central portions of front portions of opposite side walls 61*a* and 61*a* and upper and lower walls 61*b* and 61*c* of the hood portion 61 of the female connector housing 60 at an outer surface thereof, and each of the projections 64 serves as a holding member for holding the provisional retaining engagement between the projection 26*a* of the associated elastic arm 26 of the holder 20 and the associated elastic retaining piece portion 34 of the cover 30, and also serves as a cancellation member for canceling the provisional retaining engagement between the projection 26*a* of the elastic arm 26 of the holder 20 and the elastic retaining piece portion 34 of the cover 30 when completing the fitting connection between the two connector housings 50 and 60 and when disengaging the two connector housings from each other. The projection 64 has a generally trigonal prism-shape, and its front side is formed into a slanting surface (retaining surface) 64*a*, and also its rear side is formed into a slanting surface (disengaging surface) 64*b*.

Figure 8B:
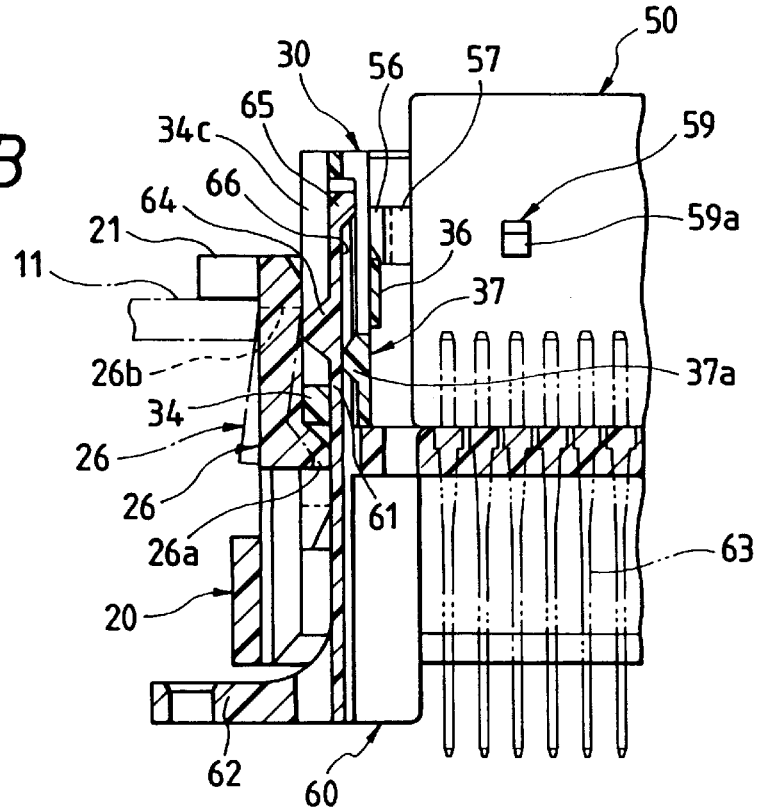
FIG. 8B is a cross-sectional view of important portions of the two connector housings completely fitted together.

As shown in FIGS. 8A, 8B and 9, the provisional-retainment cancellation projections 65 of a generally trapezoidal cross-section for being respectively engaged with and disengaged from the projections 37*a* of the provisional-retainment cancellation arms 37 of the cover 30 are formed respectively on the inner surfaces of the opposite side walls 61*a* and 61*a* of the hood portion 61 at the front end thereof. An escape groove 66 for receiving the projection 37*a* of the associated provisional-retainment cancellation arm 37 of the cover 30 is formed in the central portion of the inner surface of each of the opposite side walls 61*a* and 61*a* of the hood portion 61.

As shown in FIGS. 9 and 18, ribs (engagement portions) 67 are integrally formed on the front portion of the lower wall 61*c* of the hood portion 61 of the female connector housing 60 at the inner surface thereof. A projection 67*a* is integrally formed at an upper end portion of a rear surface of each rib 67, and a distal end 44 of the associated lever 40 can be disposed in sliding contact with this projection 67*a*. When fitting the two connector housings 50 and 60 together (that is, when slidingly inserting the hood portion 61 of the female connector housing 60 into the space between the outer and inner walls 31 and 32 of the cover 30 so as to draw the female connector housing 60 onto the male connector housing 50) and when disengaging the two connector housings from each other, the distal end 44 of each lever 40 is brought into sliding contact with the associated projection 67*a*, so that this projection 67*a* serves as a fulcrum for the lever 40. Lever escape grooves 68 are formed through the lower wall 61*c* of the hood portion 61, and each lever escape groove 68 extends from the rear end of the associated rib 67 to a vertical partition wall 61*d*. Lever push portions 69, against which the intermediate portions 43 of the levers 40 can abut, respectively, are integrally formed at a lower portion of the partition wall 61*d*.

As shown in FIGS. 1 and 4, the two guide grooves 29 are formed respectively at upwardly-projected portions 20*e* (having an inverted U-shape) of the upper wall 20*a* of the holder 20. Upwardly-projected portions 31*e* of an inverted U-shape are formed respectively at those portions of the upper wall portion of the outer wall 31 of the cover 30 opposed respectively to the projected portions 20*e*. Upwardly-projected portions 32*e* of an inverted U-shape are formed respectively at those portions of the upper wall portion of the inner wall 32 of the cover 30 opposed respectively to the projected portions 20*e*. Upwardly-projected portions 61*e* of an inverted U-shape are formed respectively at those portions of the upper wall 61*b* of the hood portion 61 of the female connector housing 60 opposed respectively to the projected portions 20*e*.

In the connector 10 of this embodiment, when the male connector housing 50, connected to the wire harness W, is to be mounted in the mounting hole 12 in the inner panel 11 through the holder 20 as shown in FIGS. 10 and 11, the holder 20 is inserted into the mounting hole 12 from the rear side of the inner panel 11, and is pushed, so that the inner panel 11 is held between the upper and lower elastic retaining portions 22 of the holder 20 (held against the front surface 11*a* of the inner panel 11) and the stoppers 21 (held against the rear surface 11*b*), thereby retaining this assembly relative to the inner panel 11. In this fitting operation, the upper and lower aligning portions 24 of the holder 20 are held against the peripheral edge of the mounting hole 12 in the inner panel 11, and even if the holder 20 is moved right, left, upward and downward, the aligning portions 24 are elastically deformed to achieve the alignment (that is, to center the holder 20 and etc., relative to the mounting hole 12), so that the fitting and fixing operation can be positively effected. Even after this fitting operation, the holder 20 tends to be centered relative to the mounting hole 12 because of the elastic nature of the aligning portions 24, the area of contact of each elastic retaining portion 22 with the inner panel 11 can be kept constant, and therefore the whole of the connector 10 can be retained or fixed relative to the inner panel 11 with an increased force, and besides a space for the connector-mounting portion of the inner panel 11 can be saved.

After the male connector housing 50 is mounted in the mounting hole 12 in the inner panel 11 through the holder 20, the female connector housing 60 is fitted on the male connector housing 50 in its fitting stand-by condition. The fitting connection between the male and female connector housings 50 and 60 will be described with reference to FIGS. 12A to 12D. In an initial fitted condition (FIG. 12A) of the two connector housings 50 and 60 in which the hood portion 61 of the female connector housing 60 is inserted in the space between the outer and inner walls 31 and 32 of the cover 30, the fitting stand-by condition of the male connector housing 50 is maintained by the engagement of the projection 26*a* of each elastic arm 26 of the holder 20 with the distal end surface 34*a* of the associated elastic retaining piece portion 34 of the cover 30. Thanks to the provision of the tapering surface 25 of the holder 20 and the tapering surface 33 of the cover 30, the hood portion 61 of the female connector housing 60 can be smoothly inserted into the space between the outer and inner walls 31 and 32 of the cover 30 to be fitted on the male connector housing 50. Therefore, the fitting-side end of the hood portion 61 of the female connector housing 60 will not strike against the front ends of the holder 20 and the cover 30, and therefore the provisional retaining engagement between the projection 26*a* of each elastic arm 26 of the holder 20 and the distal end surface 34*a* of the associated elastic retaining piece portion 34 of the cover 30 will not be canceled.

Figure 12A:
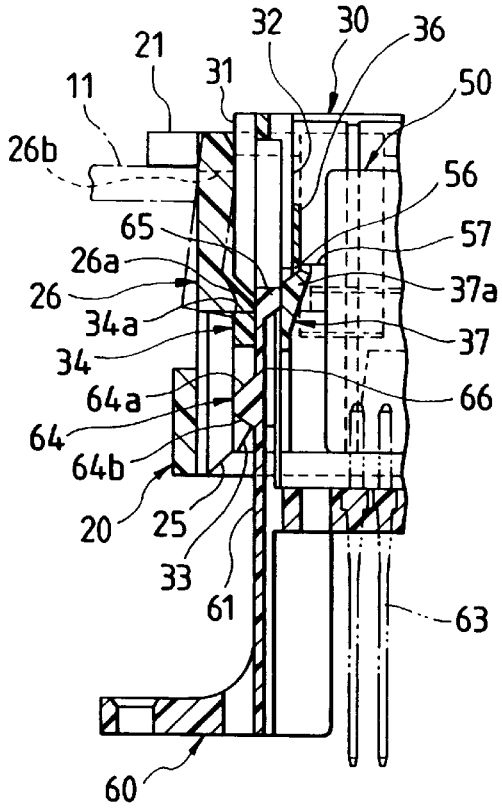
FIG. 12A is a view showing the initial fitted condition of the connector.

As shown in FIG. 12A, when each provisional-retainment cancellation projection 65 of the hood portion 61 of the female connector housing 60 is brought into engagement with the projection 37*a* of the associated elastic provisional-retainment cancellation arm 37 of the cover 30 to flex this arm 37 inwardly after the fitting connection between the two connector housings 50 and 60 is started, the associated provisionally-retaining lock portion 56 of the male connector housing 50 is pushed inwardly. As a result, each elastic arm 57 of the males connector housing 50 is flexed inwardly, so that the provisional retaining (locking) engagement between the provisionally-retaining lock portion 56 and the provisionally-retaining stopper portion 36 of the cover 30 is canceled, and the male connector housing 50 slides within the inner wall 32 of the cover 30 toward the rear side thereof. When the fitting operation is completed, the projection 37*a* of each elastic provisional-retainment cancellation arm 37 of the cover 30 is received in the associated escape groove 66 in the hood portion 61 of the female connector housing 60 as shown in FIG. 12C, so that the provisional-retainment cancellation arm 37 is restored into its initial condition.

Figure 12B:
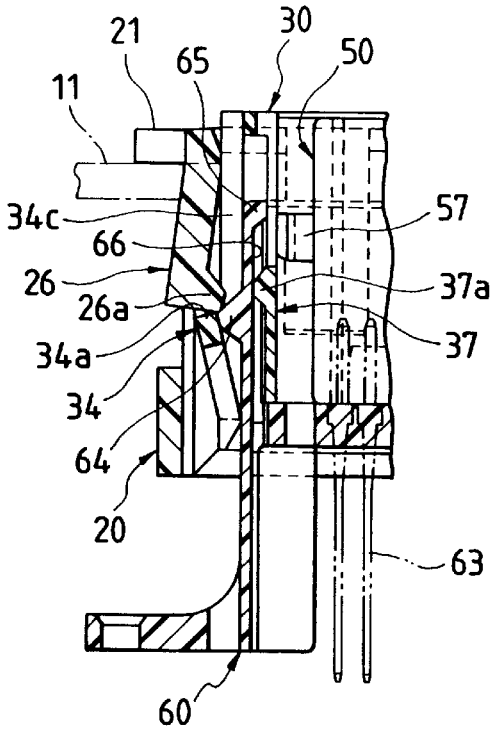
FIG. 12B is a view showing a half-fitted condition of the connector.

Then, as shown in FIG. 12B, during the fitting connection between the two connector housings 50 and 60, each elastic retaining piece portion 34 of the cover 30 is elastically deformed outwardly by the associated projection 64 of the female connector housing 60, and the distal end surface 34*a* of the elastic retaining piece portion 34 engages the upper end surface of the associated elastic arm 26 of the holder 20, so that the provisional retaining engagement between the projection 26*a* of each elastic arm 26 of the holder 20 and the distal end surface 34*a* of the associated elastic retaining piece portion 34 of the cover 30 is more positively maintained.

Figure 12C:
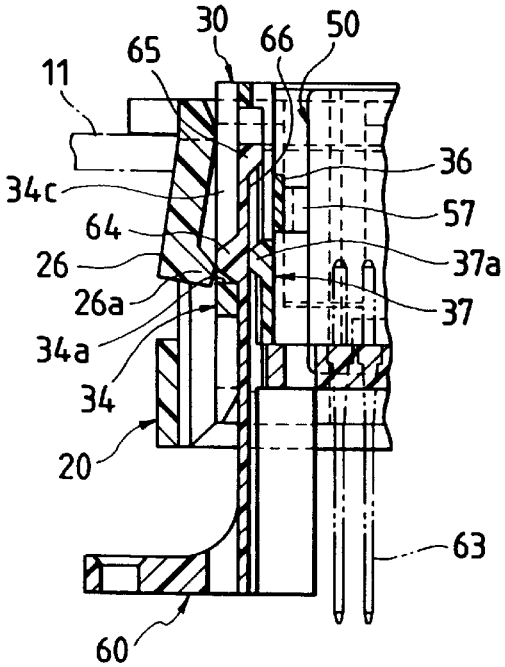
FIG. 12C is a view showing a completely-fitted condition of the connector.
Figure 12D:
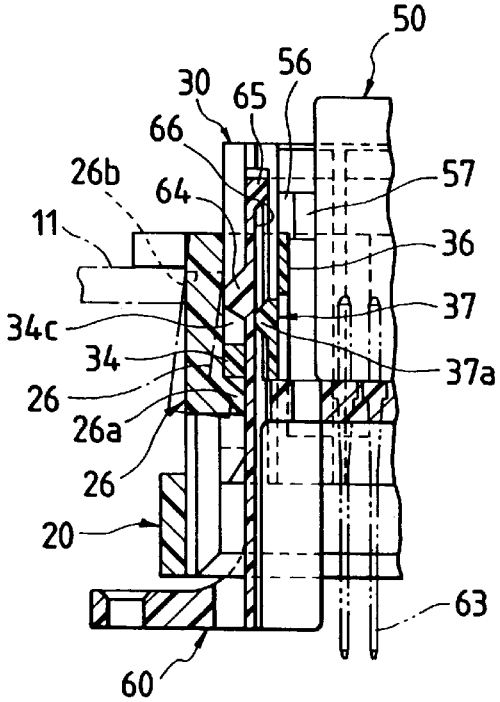
FIG. 12D is a view showing the completely-fitted condition of the connector in its centered or aligned condition.

Then, as shown in FIG. 12C, when the fitting connection between the two connector housings 50 and 60 is completed, each projection 64 of the female connector housing 60 is received in the notch 34*c* in the associated elastic retaining piece portion 34 of the cover 30. At this time, the slanting surface 64*a* of each projection 64 of the female connector housing 60 presses the projection 26*a* of the associated elastic arm 26 of the holder 20 outwardly to elastically deform this elastic arm 26 outwardly. As a result, the provisional retaining engagement between the projection 26*a* of each elastic arm 26 of the holder 20 and the distal end surface 34*a* of the associated elastic retaining piece portion 34 of the cover 30 is canceled, and the two connector housings 50 and 60, thus fitted together, slide rearwardly in unison within the cover 30, as shown in FIGS. 12C and 12D. When this sliding movement is completed, the connector 10 is in a centered or aligned condition as shown in FIGS. 12D and 13.

Figure 15:
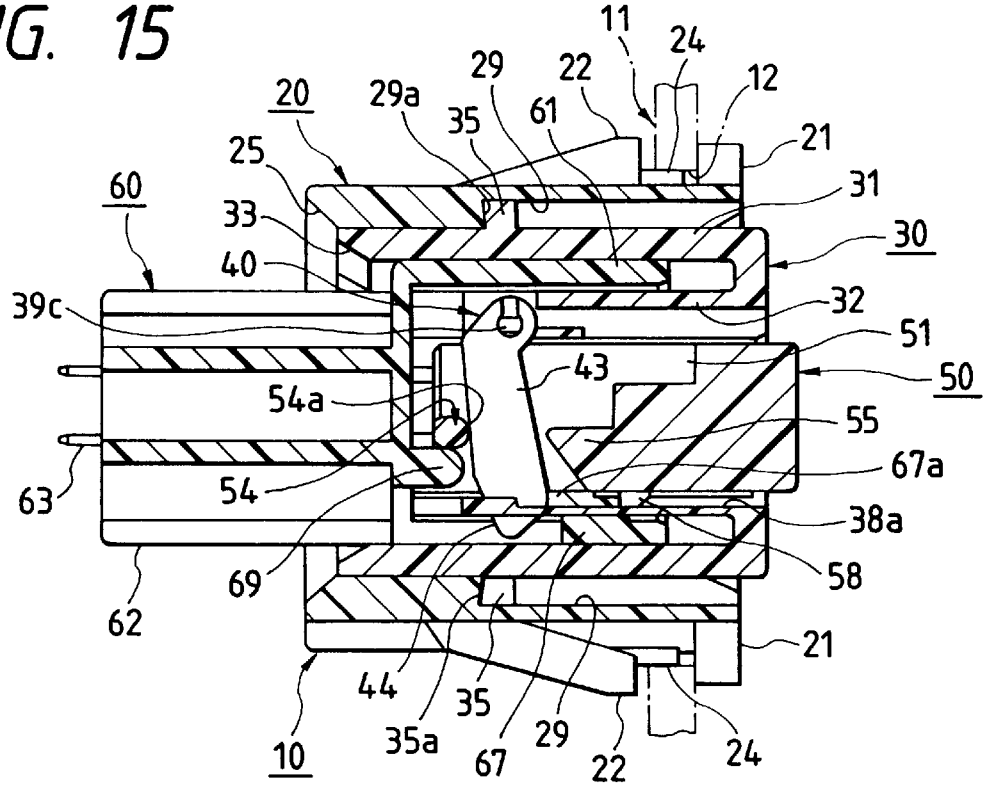
FIG. 15 is a cross-sectional view showing a half-disconnected condition of the connector.
Figure 16:
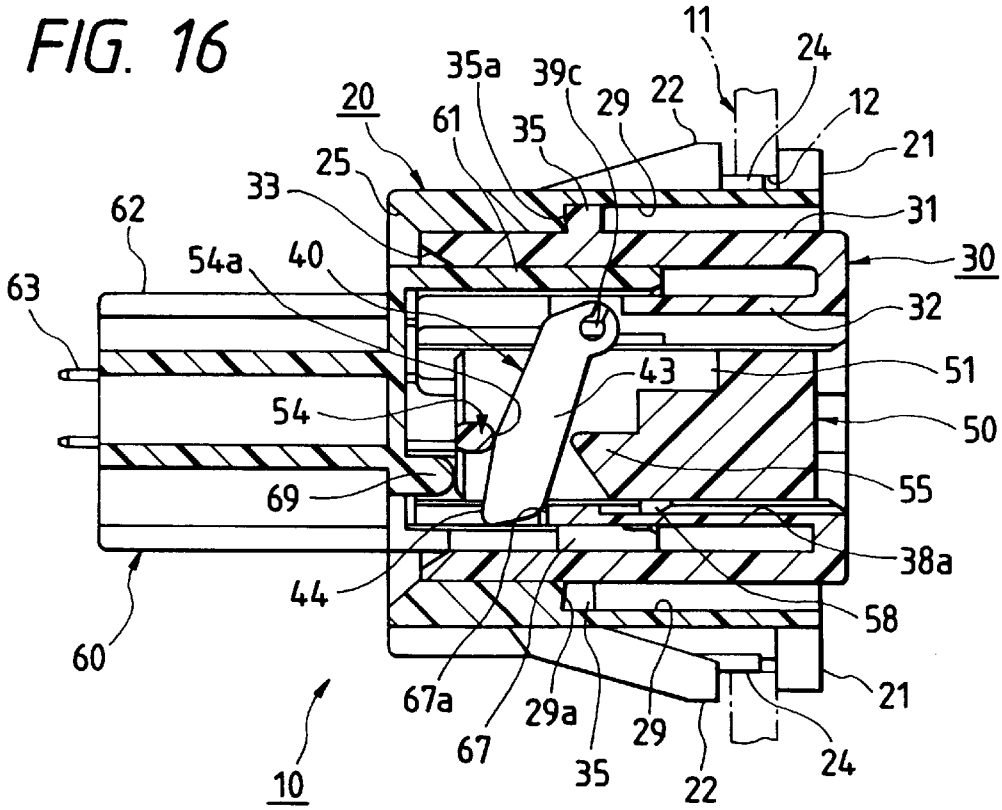
FIG. 16 is a cross-sectional view showing a half-disconnected condition of the connector.
Figure 17:
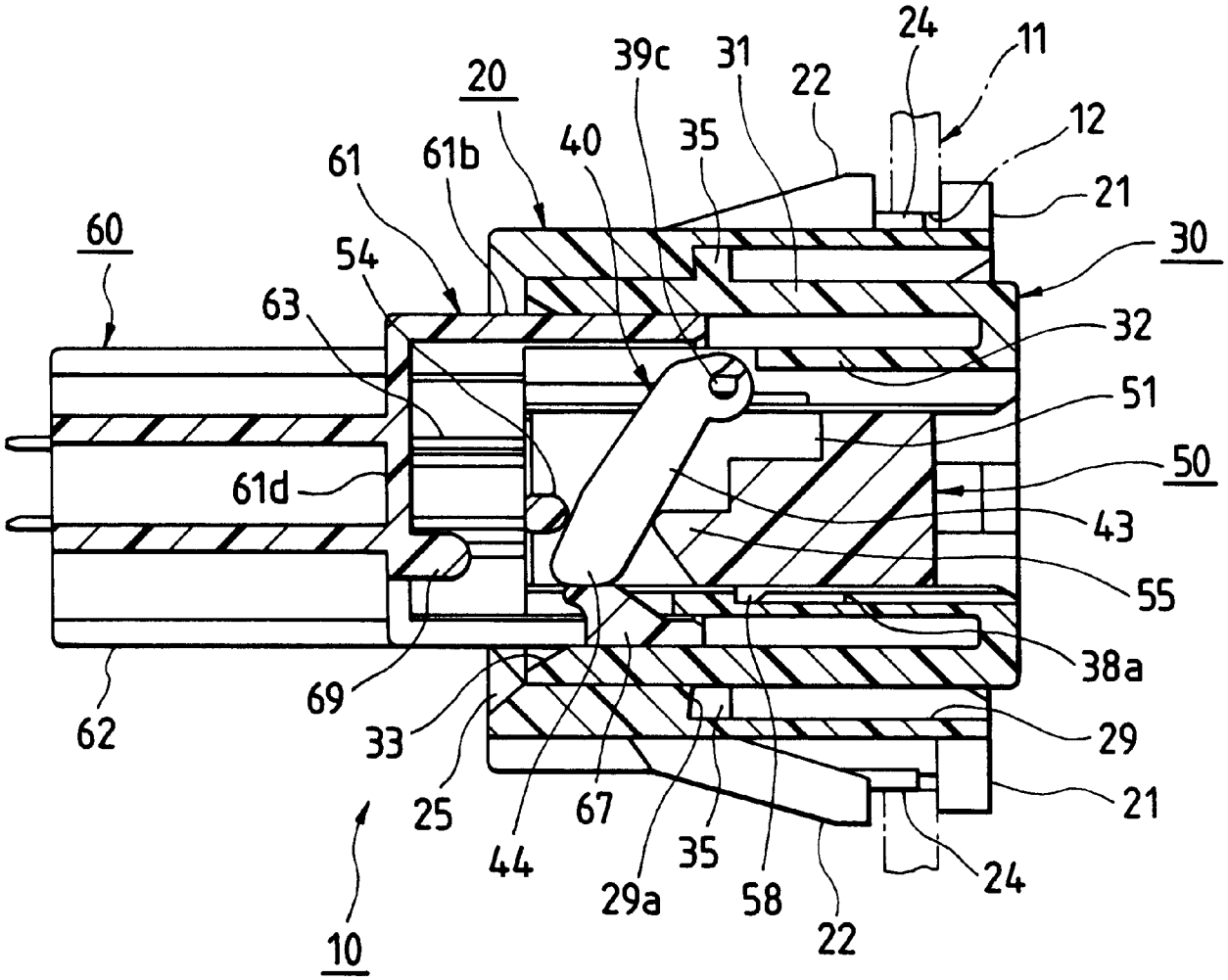
FIG. 17 is a cross-sectional view of the half-disconnected condition of the connector, in which terminals are disconnected for their respective mating terminals.

The process of the fitting connection between the two connector housings 50 and 60 from the initial fitted condition to the fitting-completed condition will be described with respect to the levers 40. When the hood portion 61 of the female connector housing 60 is inserted into the space between the outer and inner walls 31 and 32 of the cover 30 as shown in FIG. 17, and the female connector housing 60 is pushed in the direction toward the male connector housing 50, the distal end 44 of each lever 40 contacts the lever-fulcrum projection 67*a* of the associated rib 67 provided within the hood portion 61 of the female connector housing 60, so that the lever 40 begins to be pivotally moved as shown in FIG. 16. Then, when the female connector housing 60 is further pushed in the fitting direction as shown in FIG. 15, the hood portion 61 of the female connector housing 61 is drawn into the space between the outer and inner walls 31 and 32 of the cover 30 by the leverage of the levers 40 (The support shaft 39*c*, pivotally supporting the proximal end 41 of the lever 40, serves as a force-applying point, and the arcuate surface 54*a* of the guide portion 54 of the male connector housing 50 serves as the operating point, and the projection 67*a* of the rib 67 of the female connector housing

60 serves as a fulcrum), so that the two connector housings 50 and 60 are fitted together. Therefore, merely by sliding the female connector housing 60 in the fitting direction with a small operating force, the two connector housings 50 and 60 can be easily fitted together because of the leverage of the levers 40.

Figure 13:
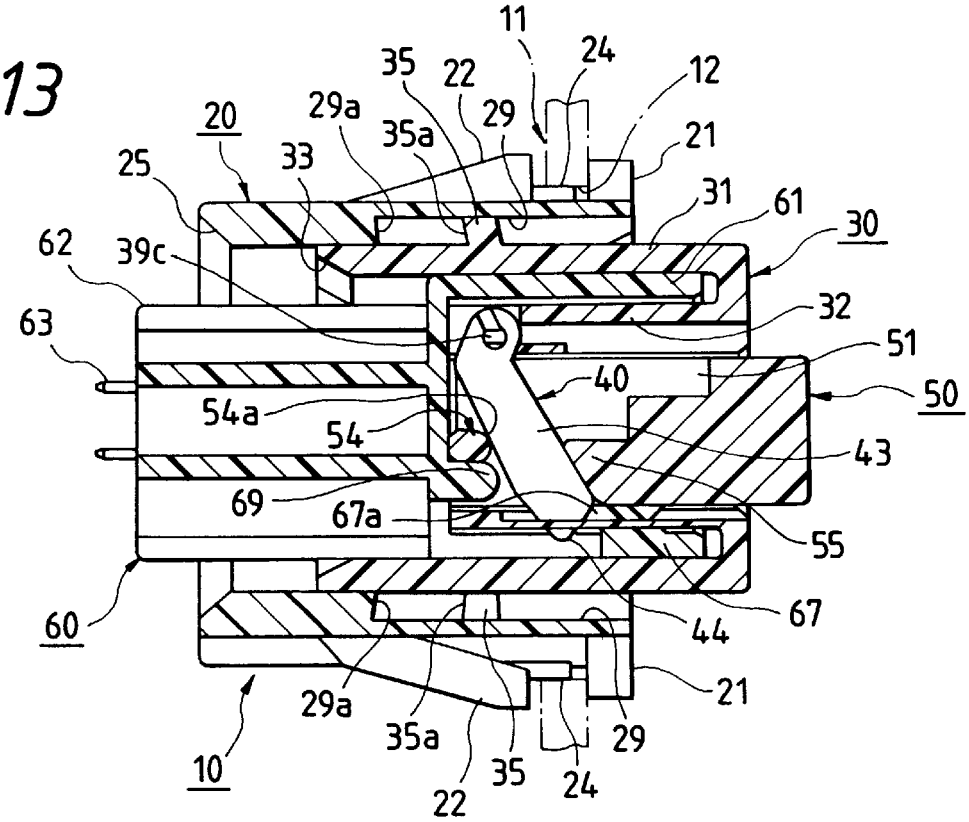
FIG. 13 is a cross-sectional view showing the completely-fitted condition of the connector in its aligned condition.
Figure 14:
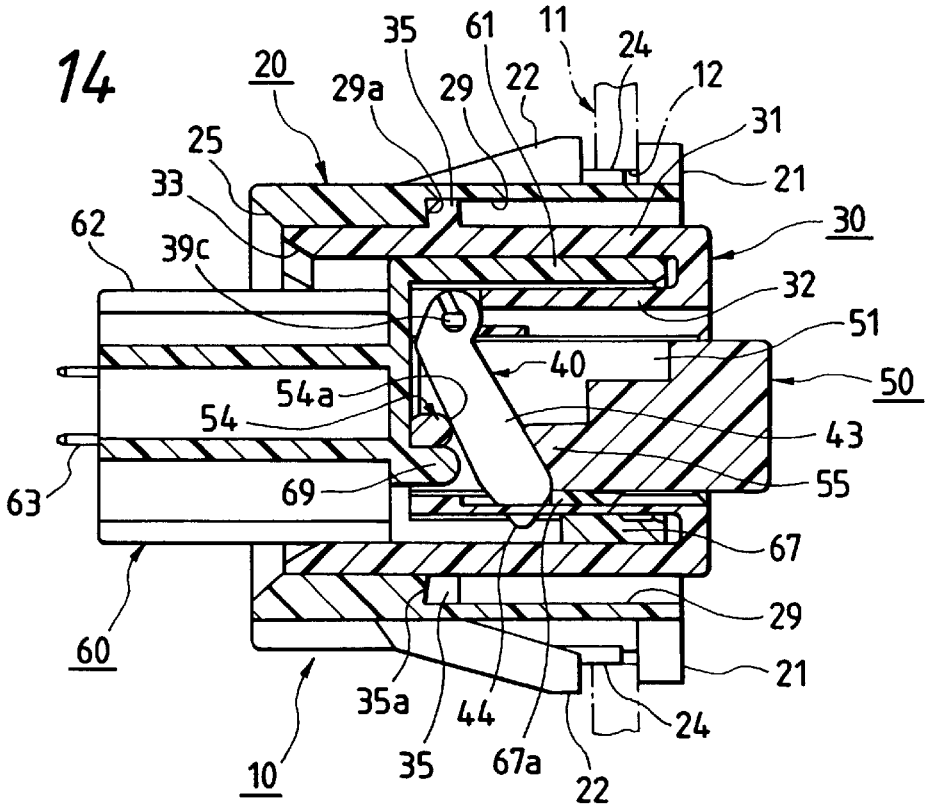
FIG. 14 is a cross-sectional view of the connector in its completely-fitted condition.

When the two connector housings 50 and 60, held in the completely-fitted condition shown in FIGS. 13 and 14, are to be disconnected from each other, this disconnecting operation is effected in the sequence shown in FIGS. 13 to 17. More specifically, during the process from the start (FIG. 14) of the disconnection of the two connector housings 50 and 60 from each other to the disconnection (FIG. 17) of the female terminals 53 from the male terminals 63, the distal end 44 of each lever 40 is held in contact with the lever-fulcrum projection 67*a* of the associated rib 67 within the hood portion 61 of the female connector housing 60, and this lever 40 is pivotally moved in a direction opposite to the direction of the lever 40 during the fitting operation, and effects the disconnection while drawing the guide portion 54 of the male connector 50. Then, in the condition of FIG. 17, simultaneously when each rib 67 within the hood portion 61 of the female connector housing 60 passes past the lower side of the distal end 44 of the associated lever 40, the female terminals 53 are disconnected from the male terminals 63, respectively. Therefore, merely by sliding or withdrawing the female connector housing 60 in the disconnecting direction with a small operating force, the two connector housings 50 and 60 can be easily disconnected from each other because of the leverage of the levers 40.

As described above, in the first aspect of the present invention, the tapering surfaces for guiding the fitting movement of the other connector housing are formed respectively at those ends of the holder and cover for receiving the other connector housing, and the holder and the cover can be provisionally retained relative to each other through the provisionally-retaining members so that the tapering surface of the holder and the tapering surface of the cover can be disposed substantially flush with each other. Therefore, when fitting the male and female connector housings together, the other connector housing can be smoothly introduced into the one connector housing because of the provision of the tapering surfaces of the holder and cover. Therefore, when fitting the two connector housings together, the provisional retaining engagement between the holder and the cover can be positively maintained, and the two connector housings can be fitted together easily and positively.

In the second aspect of the present invention, if the tapering angle of the tapering surface of the holder is represented by X, and the tapering angle of the tapering surface of the cover is represented by Y, the tapering surfaces are so formed that $Y \geqq X$ can be established. Therefore, even if the other connector housing strikes against the fitting-side ends of the holder and cover when fitting the two connector housings together, the other connector housing can be easily and positively guided toward the one connector housing through the tapering surfaces of the holder and cover, and therefore the improper fitting connection between the male and female connector housings is prevented.

What is claimed is:

1. A connector attachable to a mounting member, comprising:

a cover;

a first connector housing retained within the cover in a fitting stand-by condition;

a holder receiving the cover therein in a provisionally-retained condition, the holder being attachable to the mounting member;

a second connector housing detachably fitted to the first connector housing held in the fitting stand-by condition within the cover held in the provisionally-retained condition relative to the holder;

provisionally-retaining members, which maintain the fitting stand-by condition of the first connector housing, provided respectively at the holder and the cover; and tapering surfaces, which guide fitting movement of the second connector housing, respectively formed at ends of the holder and the cover for receiving the second connector housing, wherein the holder and the cover are provisionally retained relative to each other so that the tapering surface of the holder and the tapering surface of the cover are substantially flush with each other.

2. A connector according to claim 1, in which, when a tapering angle of the tapering surface of the holder is represented by X, and a tapering angle of the tapering surface of the cover is represented by Y, the tapering surfaces are so formed that $Y \geqq X$ can be established.

* * * * *